US005168146A

United States Patent [19]

Marshall et al.

[11] Patent Number: 5,168,146

[45] Date of Patent: Dec. 1, 1992

[54] BI-DIRECTIONAL SNAP-ACTION REGISTER DISPLAY MECHANISM

[76] Inventors: John D. Marshall, 172 Foxhollow Rd., Montgomery, Ala. 36109; Thierry W. Swinson, 145 Price Rd., Wetumpka, Ala. 36092; Richard L. Bennett, Rte. 5, Box 99, Tallassee, Ala. 36078; Kenneth L. Cole, Rte. 5, Box 653, Wetumpka, Ala. 36092

[21] Appl. No.: 433,864

[22] Filed: Nov. 9, 1989

[51] Int. Cl.[5] ..... G06C 7/10

[52] U.S. Cl. ..... 235/133 R; 235/134; 235/135; 235/139 R

[58] Field of Search ..... 235/133 R, 134, 135, 235/139 RA, 144 HC, 96

[56] References Cited

U.S. PATENT DOCUMENTS

| | | | |
|---|---|---|---|
| 3,077,302 | 2/1963 | Solari | 235/134 |
| 3,643,072 | 2/1972 | Szeluga | 235/144 HC |
| 4,085,287 | 4/1978 | Kullmann et al. | 178/66 R |
| 4,204,112 | 5/1980 | Lane | 235/133 R |
| 4,298,791 | 11/1981 | Muller et al. | 235/134 |

*Primary Examiner*—Brian W. Brown
*Assistant Examiner*—Eddie C. Lee

[57] ABSTRACT

A bi-directional snap-action register mechanism for an odometer-type mechanical register display. The mechanism includes at least one register display wheel and a bi-directional cam mounted coaxially along a common shaft with the register display wheel. The bi-directional cam engages a helical groove formed along the shaft to allow lateral displacement of the bi-directional cam in a direction parallel to a rotational axis of the shaft. A pin is biased by a spring into contact with the bi-directional cam. Rotation of the shaft causes the bi-directional cam to be moved with respect to the pin. The cam abruptly rotates through a predetermined angular distance when the point of contact of the biased pin with the cam moved from a smooth portion to a step transition portion of the cam. The abrupt rotation of the cam is communicated to the register display wheel to cause a new display position to be moved into view.

9 Claims, 4 Drawing Sheets

BI-DIRECTIONAL SNAP-ACTION REGISTER DISPLAY MECHANISM

BACKGROUND OF THE INVENTION

1. Field of the Invention

The invention relates to the field of register display mechanisms, and more particularly to a mechanical display of the odometer decade counter type which can be operated in both forward and reverse directions with positive indexing of the digits being displayed by the register.

2. Description of the Prior Art

Many utility meters utilize odometer-type decade counters in order to display the quantity of a commodity (e.g. gas, water or electricity) being measured by the meter. These registers take the form of a decade counter having one or more register display wheels mounted side by side along a common axis. The least significant digit wheel (generally the rightmost wheel on the display) is connected to a gear train which is turned by the measuring mechanism of the meter. The least significant digit wheel is connected to the next most significant digit wheel by a simple escapement mechanism. Decade counters of this type are well-known and their operation and construction will not be described in further detail.

Conventional odometer-type decade counter register display mechanisms include some sort of "roll-back" prevention mechanism which allows the register wheels to rotate in only one direction (e.g. from lower quantities to higher quantities). This anti-"roll-back" mechanism conventionally takes the form of a one-way escapement mechanism comprising an asymmetrical cam and spring-loaded "catch" or pin. The anti-"roll-back" mechanism is employed to ensure that the meter cannot be tampered with, and specifically to prevent the amount being display from being reset to a lower quantity. However, under current regulatory schemes in force in some jurisdictions, it is now necessary for a meter to measure the flow of water or gas or electricity bi-directionally, i.e. into or out of the metering mechanism. For example, in some jurisdictions, a consumer who generates his own electricity (so-called co-generation) may pass it back to the electrical utility and receive a credit for the amount so transferred. A conventional one-way register mechanism with roll-back prevention is incapable of showing the net transfer of such a commodity.

An additional feature of modern meter register display mechanisms is the inclusion of electronic encoders which enable the position of the various register display wheels, and hence the displayed reading, to be remotely read. For example, U.S. Pat. No. 4,085,287 for "Data Transmitter for Remote Meter Reading" discloses a system for remotely reading an encoded water meter register of the type described above. One or more of the register display wheels have a small circuit board arranged next to them. Each circuit board has a series of electrical contacts arranged in a circle next to the display wheel. The display wheel carries an electrical wiper or contact arm. When energized, the position of the wiper arm on one of the contacts indicates the position of the register wheel and thus the digit being displayed.

One problem associated with the type of register shown in U.S. Pat. No. 4,085,287 is that if the position of the register display wheel is between two display positions, (e.g. it is between two displayed numbers) the reading being taken by the remote meter reading equipment will be ambiguous. This means that the meter reader will have to wait until more water has passed through the meter sufficient to move the register wheel into an unambiguous display position.

In order to overcome this problem, it has been proposed to utilize the repulsive effect of two magnets having like poles disposed opposite each other, one on the register display wheel and the other mounted at a fixed position adjacent the register display wheel. The interaction of the two like magnetic poles when they pass adjacent each other causes the register wheel to "snap-over" and move to the next adjacent position. Unfortunately, the arrangement is relatively costly due to the use of the two magnetic components. Furthermore, the use of a magnet on the register display wheel causes it to become unbalanced, thus affecting the accuracy of the displayed reading. Furthermore, the magnetic assembly could be tampered with or defeated with the use of a large magnet placed nearby. In addition, for any register which will be driven in a forward or reverse direction, it is necessary that on the least significant digit display wheel the positive snap-action take place on the "9" when going forward and on the "0" going in reverse. With the magnetic "snap-over" system described above, the "snap-over" action takes place only at one position.

Another potential solution to the problem associated with ambiguous display readings is to increase the number of contacts on the adjacent encoder circuit board. While reducing the chance of ambiguity, with this arrangement it is still possible for an ambiguous reading to occur. In addition, this arrangement suffers from the drawback of increased drag due to friction between the wiper arm and the additional contact pads. In any register display mechanism, drag and friction should be kept to a minimum so as to not affect the accuracy of the meter reading. This is because the metering mechanisms employed are generally accurate as long as a low load or drag is present at their output to the display mechanism. High drag present in the mechanism may cause the metering mechanism to slow down and cause the display to read less than the actual amount of the quantity being measured by the metering mechanism.

SUMMARY OF THE INVENTION

These and other drawbacks of prior art register display mechanisms are overcome by the present invention. The invention comprises a bi-directional snap-action register mechanism for a mechanical register display having at least one display wheel with at least one display position provided thereon. A bi-directional cam is mounted coaxially along a shaft with the register display wheel. The bi-directional cam consists of two spiral surfaces arranged next to each other, each spiral surface having a smooth portion and a step transition portion. The two spiral surfaces are oriented symmetrically mirror-reversed with respect to each other and arranged along a guide portion of the shaft having a helical groove. The bi-directional cam includes means for engaging the helical groove of the guide to allow lateral displacement of the bi-directional cam in a direction parallel to a rotational axis of the guide. The register mechanism further includes a pin biased by biasing means, such as a spring, into contact with one of the spiral surfaces of the bi-directional cam. Means are provided for coupling the bi-directional cam to the register display wheel.

In operation, rotation of the shaft or guide causes the biased pin to engage one of the two spiral surfaces of the bi-directional cam and causes the cam to abruptly rotate through a predetermined angular distance when the rotation of the cam causes the point of contact of the biased pin with the engaged spiral surface to move from the smooth portion of the engaged surface to the step transition portion of the engaged spiral surface. The abrupt rotation of the cam is communicated to the display wheel by the coupling means to cause a new display position to be moved into view.

Depending upon the direction of axial rotation of the shaft or guide, the biased pin contacts one of the two spiral surfaces of the cam. The particular spiral surface which is followed by the biased pin is determined by the direction of rotation of the shaft or guide and cam. The pin is urged into contact with the spiral surface offering the least amount of rotational resistance to the pin. This will be the spiral having its smooth portion adjacent to the point of contact of the pin with the cam, as opposed to the spiral surface having the step transition portion adjacent to the point of contact of the pin with the cam. By giving the cam the ability to move laterally along the guide, through cooperation with the helical groove of the guide, the spiral surface offering the path of least resistance will be automatically urged into contact with the point of engagement of the biased pin.

In a preferred embodiment, the coupling means comprises a drive wheel mounted between the register display wheel and the bi-directional cam, and a driven wheel mounted coaxially along the shaft and arranged in the same plane as the drive wheel and having an annular opening for receiving the drive wheel. The drive wheel includes means for engaging and driving the driven wheel and register display wheel over a predetermined angular distance and for rotating freely with respect to the driven wheel and register display wheel over another predetermined angular distance. The drive wheel further includes means coupled to the bi-directional cam to cause the drive wheel to rotate with the bi-directional cam.

The foregoing arrangement enables the bi-directional cam to "free wheel" with respect to the driven wheel and register display wheel except over a predetermined angular portion of its rotation. Thus, when the abrupt transition of the point of contact of the biased pin with the smooth surface of the engaged spiral surface to the step transition of the engaged surface occurs, the register display wheel will be driven through a predetermined angular distance to bring a new display position into view.

Preferably, the driven register display wheel is coupled, via a decade counter mechanism, to further register display wheels disposed coaxially along the common shaft. This enables the "snap-action" of the driven register display wheel to be communicated to the other register display wheels. A remotely interrogable encoder mechanism may be associated with one or more of the register display wheels.

The use of self-lubricating plastics for the biased pin and bi-directional cam ensures that drag and torque effects of the cam will be minimized.

The register display mechanism of the present invention is relatively inexpensive to manufacture and is simple in construction and operation, while providing the advantages of unambiguous display readings, low drag and friction, ease of adaptability for use with conventional remotely interrogable register encoder mechanisms, and the ability to operate properly in both forward and reverse directions.

BRIEF DESCRIPTION OF THE DRAWING FIGURES

These and other features and advantages of the present invention will be more clearly understood from the following detailed description of the preferred embodiment of the invention, when taken in conjunction with the accompanying drawing figures wherein.

DETAILED DESCRIPTION OF THE PREFERRED EMBODIMENT

Figure 1:
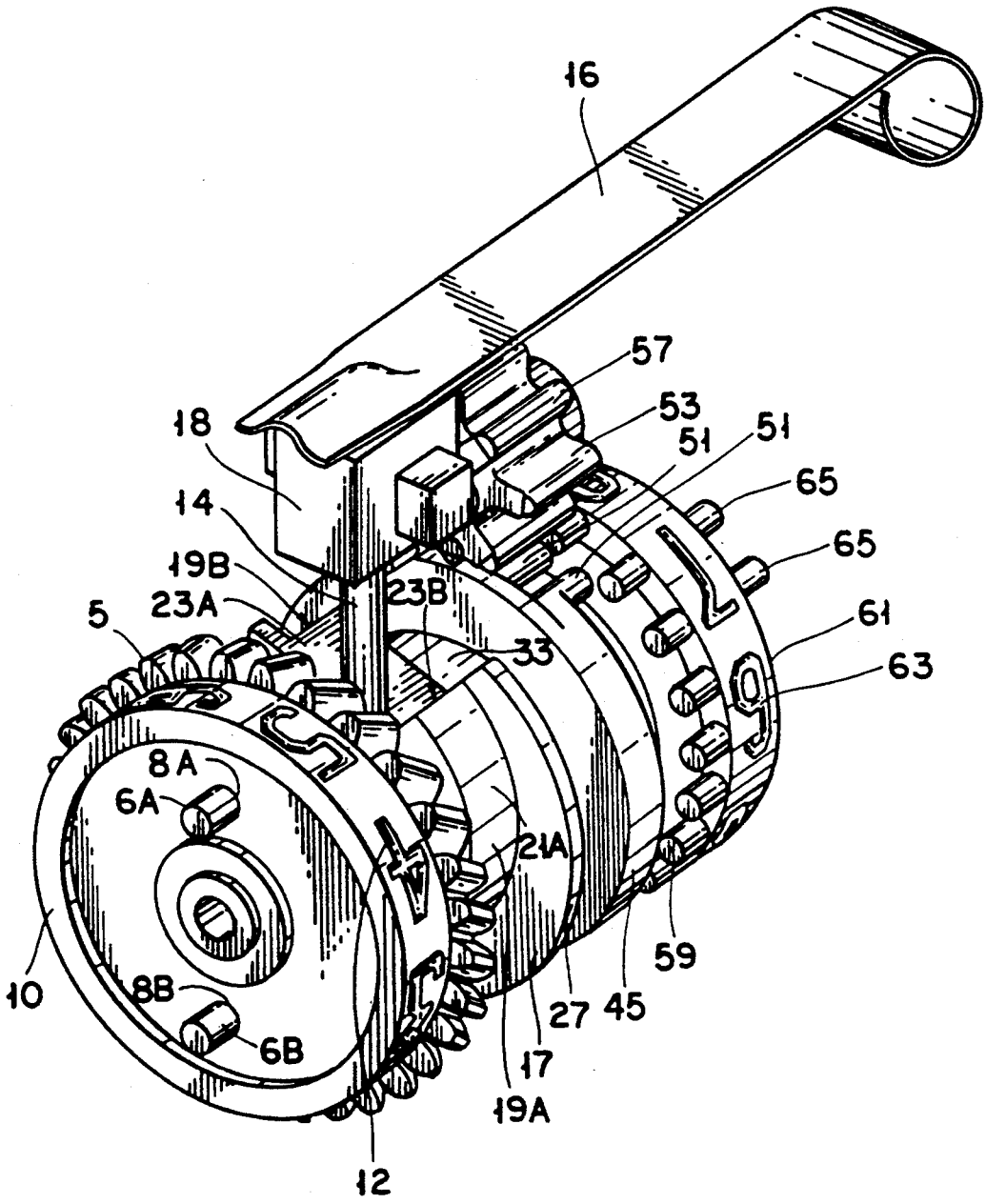
FIG. 1 is a perspective view of the bi-directional snap-action register display mechanism of the present invention.
Figure 2:
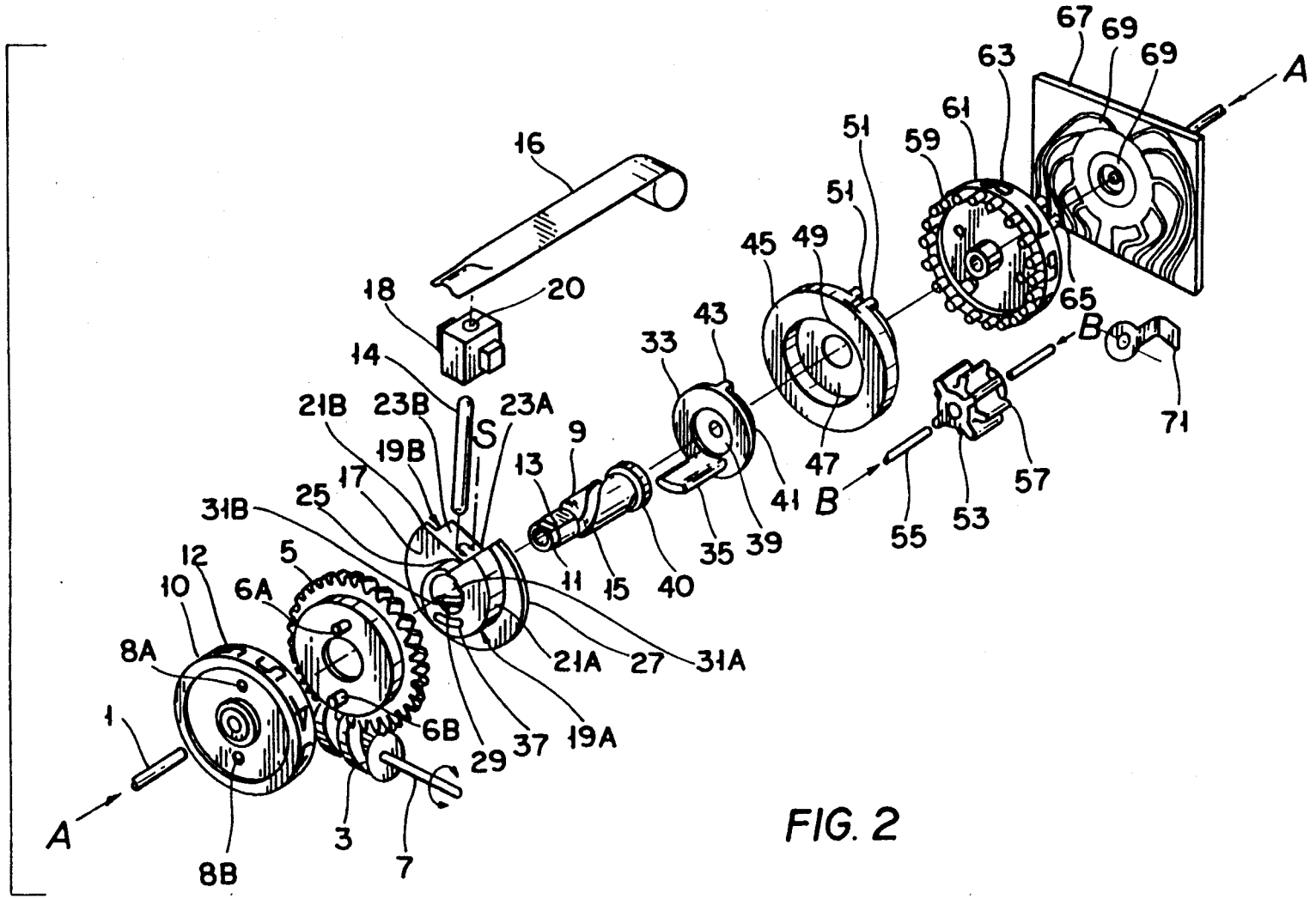
FIG 2 is an exploded perspective view of the register mechanism of FIG. 1 showing the component parts more clearly.

Referring to the drawing figures, shaft 1 defines a common rotational axis A and carries on it a driven gear train consisting of a worm gear 3 and driven gear 5. Worm gear 3 is connected via driven shaft 7 to a metering mechanism (not shown). The metering mechanism is conventional and can comprise, for example, the output from the measuring mechanism of a water meter, gas meter, electricity meter or the like.

A guide 9 is also disposed along shaft 1 and takes a form of a sleeve having a axial opening 11 for receiving shaft 1. One end of guide 9 includes a flattened portion 13 which is arranged to fit into a similarly shaped opening formed about the center of driven gear 5, so that driven gear 5 and guide 9 turn together as a unit about axis A of shaft 1.

Guide 9 further includes at least one helical groove 15 formed on its surface. Preferably, there are a pair of such grooves 15 formed along the length of guide 9 and disposed oppositely from each other.

Disposed about guide 9 is bi-directional cam 17. Bi-directional cam 17 is comprised of two spiral surfaces **19*a*, 19*b* arranged next to each other, with each spiral surface having a smooth portion 21*a*, 21*b* respectively, and a step transition portion 23*a*, 23*b*, respectively. Spiral surfaces 19*a*, 19*b* are oriented symmetrically mirror-reversed with respect to each other. More specifically, spiral surfaces 19*a*, 19*b* are mirror-reversed about a line of symmetry S extending from the common axis A of shaft 1 through a base portion 25 common to the step transition portions 23*a*, 23*b* of spiral surfaces 19*a*, 19*b***.

Bi-directional cam 17 may optionally include a wall area 27 which separates the two spiral surfaces **19*a* and 19*b***.

Bi-directional cam 17 further includes an opening 29 adapted to receive guide 9. Opening 29 includes means for cooperating with the guide 9 which preferably takes the form a pair of pins or protrusions **31*a*, 31*b* formed on the interior surface of opening 29 and arranged to engaged helical grooves 15 formed on the surface of guide 9. Of course, instead of the arrangement shown in the drawing figures, the interior surface of opening 29 could have one or more helical grooves similar to those shown at 15 formed therein and guide means 9 could be provided with pins or protrusions similar to those noted at 31***a* and 31*b*.

Mounted adjacent bi-directional cam 17 along shaft 1 is drive wheel 33. Drive wheel 33 includes an arm 35 which fits within a similarly shaped opening 37 formed in cam 17. Arm 35 of drive wheel 33 fits slidingly within opening 37 of cam 17 in such a fashion so that cam 17 may move laterally in a direction parallel to axis A of shaft 1.

Drive wheel 33 further includes an annular recessed area 39 which slidingly receives annular area 40 formed on the end of guide 9 opposite flattened portion 13.

On the side of drive wheel 33 opposite arm 35 is formed an annular lip 41 which is interrupted over a predetermined angular portion by a protrusion 43 which extends radially outward from annular lip 41 to the outer periphery of drive wheel 33.

A driven wheel 45 is mounted coaxially along the common shaft 1 and in the same plane as drive wheel 33. Driven wheel 45 has an annular opening 47 for slidingly receiving drive wheel 33. Also formed on the interior surface of annular opening 47 is a protrusion 49 which prevents drive wheel 33 from freely rotating with respect to driven wheel 45 for something less than 360', due to the interfering action of protrusion 43 of drive wheel 33 with protrusion 49 of driven wheel 45.

On the side of driven wheel 45 opposite cam 17 is formed a pair of pins 51. Pins 51 are designed to engage the teeth 57 of a gear 53. Gear 53 is disposed about a shaft 55 mounted parallel to axis A of shaft 1. Teeth 57 of gear 53 also engage a plurality of pins 59 formed about the periphery of register display wheel 61.

Register display wheel 61 is mounted for rotation about axis A of shaft 1 and include one or more display positions 63 which, for example, may be the numerals 0, 1, 2, 3, 4, 5, 6, 7, 8, 9 or other such display indicia.

Register display wheel 61 may further include a pair of pins 65 disposed on the side of register display wheel 61 opposite the bi-directional cam for engaging a gear (not shown) similar in shape to gear 53 and mounted coaxially along shaft 55. This further gear would engage an additional register display wheel (not shown) constructed similarly to register display wheel 61. Such an arrangement constitutes a type of decade counter mechanism or odometer-type display whose construction and operation is well known.

The register display mechanism of the present invention may further include remotely interrogable encoder means associated with at least one register display wheel. Such conventional mechanisms may take the form of that shown in U.S. Pat. No. 4,085,287. A circuit board 67 is arranged between register display wheels. Each circuit board has a series of electrical contacts 69 formed on both sides of the board and arranged in a circle facing adjacent display wheels. Each display wheel carries an electrical wiper or contact arm 71 which is arranged to contact an individual electrical contact 69 on circuit board 67.

When energized by means of the circuitry shown and described in the aforementioned U.S. Pat. No. 4,085,287 the position of the wiper arm 71 on a particular electrical contact 69 indicates the position of the register wheel (e.g. register display wheel 61) and the digit or position being displayed.

As shown in the drawing figures, driven gear 5 may include a pair of pins 6*a*, 6*b* formed on a side of driven gear 5 opposite cam 17. Pins 6*a*, 6*b* engage openings 8*a*, 8*b* formed in a drive indicator wheel 10. Drive indicator wheel 10 includes one or more display positions 12, e.g. the numerals 0–9 or other indicia. Drive indicator wheel 10 is designed to rotate with driven gear 5 and gives a visual indication to an observer of the direction and movement of driven gear 5.

A pin 14 is biased into contact with one of the spiral surfaces 19*a* or 19*b* by means of biasing spring 16. As shown in the drawing figures biasing spring 16 takes the form of a leaf-spring formed from a flexible material, such as copper-bronze. Alternatively, a coil spring could be utilized. Pin 14 is guided by guide block 18 having an opening 20 slidingly receiving pin 14.

Figure 3:
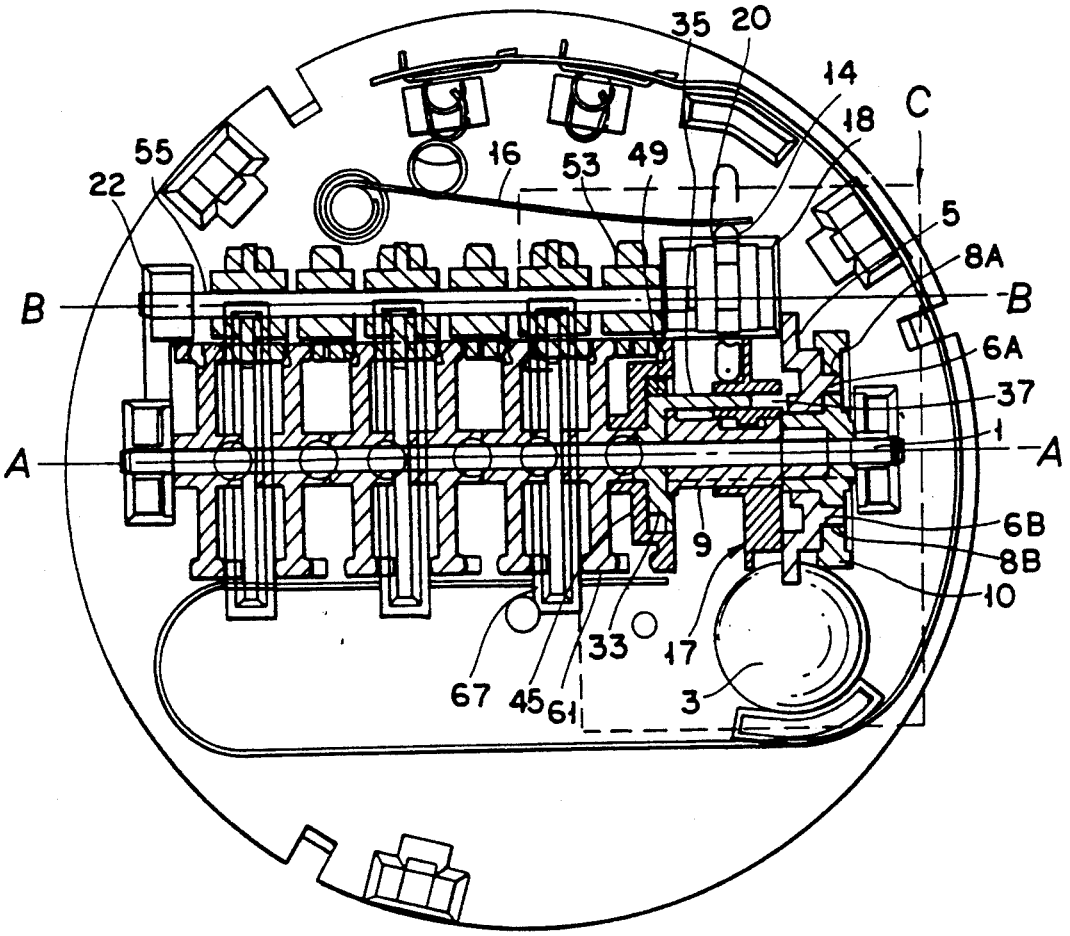
FIG. 3 is a sectional view of the register mechanism of FIG. 1 showing a complete six position register display.
Figure 4:
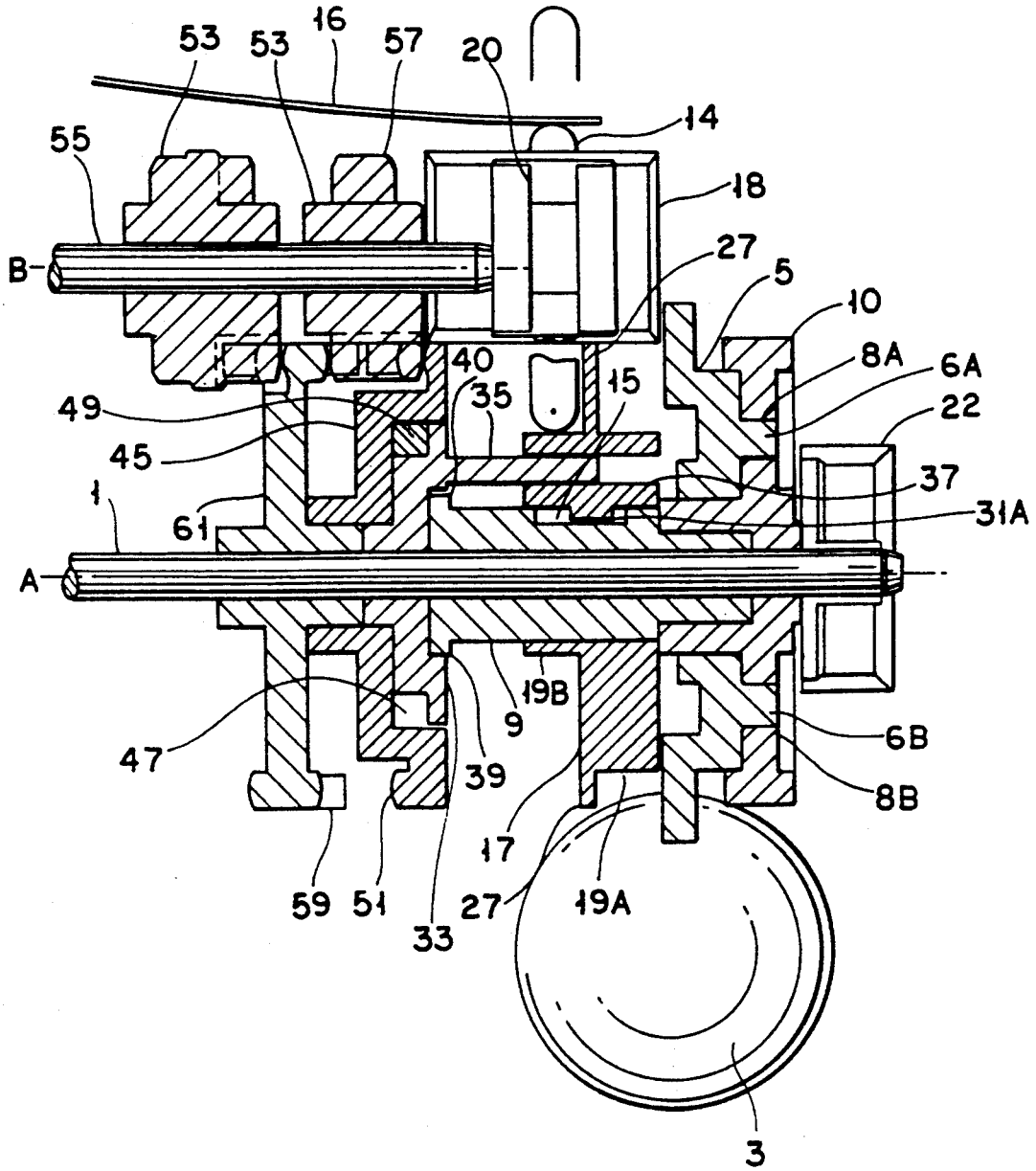
FIG. 4 is a detailed view of the area indicated by dashed box C of FIG. 3, showing the bi-directional snap-action mechanism in more detail.

As shown in FIG. 3, the ends of shafts 1 and 55, guide block 18 and spring 16 are all mounted to a frame 22.

The various components described above can be formed from a variety of materials, including various types of metals and plastics. In one embodiment of the invention shafts 1 and 55 are formed from steel and the various elements including gears 3, 5, 53, wheels 10, 33, 45, 61, guide 9, cam 17 and pin 14 are formed from a self-lubricating plastic, such as Delrin~. Such plastic parts can be readily molded, are relatively dimensionally stable and because of their self-lubricating characteristics, are smooth-running and exhibit low drag when in contact with each other.

In operation, driven shaft 7 is turned by a metering mechanism (not shown), such as the measurement mechanism from an electricity, gas or water meter. Rotation of shaft 7 turns worm gear 3 causing driven gear 5 to turn. The direction of rotation of driven gear 5 can be readily discerned by observing the motion of drive indicator wheel 10.

Rotation of driven gear 5 causes guide 9 to turn. The interaction of protrusions 31*a*, 31*b* with helical grooves 15 formed on guide 9 causes bi-directional cam 17 to move laterally (i.e. in a direction parallel to axis A of shaft 1) in a direction depending upon the direction of rotation of guide 9.

Pin 14 is biased by spring 16 into contact with the common base portion 25 of the step transition portions 23*a*, 23*b* of spiral surfaces 19*a*, 19*b*. Since the step transition portion 23*a* or 23*b* will represent a path of greater resistance to the point of contact of pin 14 with spiral surface 19*a* or 19*b*, cam 17 will move laterally with respect to guide 9 until the point of contact of pin 14 contacts the smooth portion 21*a* or 21*b* of spiral surface 19*a* or 19*b*, whichever offers the path of least resistance to pin 14.

When cam 17 reaches the end of its lateral displacement with respect to grooves of guide 9, it will begin to rotate with guide 9 and driven gear 5. The appropriate smooth portion 21*a* or 21*b* of spiral surfaces 19*a* or 19*b* will pass beneath the point of contact of pin 14 which remains in contact at all time with the spiral surface due to the biasing force provided by biasing spring 16. In addition, drive wheel 33 will begin to rotate with cam 17 since arm 35 of drive wheel 33 engages opening 37 of cam 17. Drive wheel 33 rotates smoothly within annular opening 47 of driven wheel 45. However, the presence of protrusion 43 on drive wheel 33 and protrusion 49 on driven wheel 45 prevents drive wheel 33 from freely rotating through a full 360' or more. The relative widths of protrusions 43 and 49 are dimensioned to provide a predetermined number of degrees of free rotation between drive wheel 33 and driven wheel 45. For example, the width of protrusion 43 and 49 may be adjusted to provide approximately 324′ of rotational freedom between drive wheel 33 and driven wheel 45.

As drive wheel 33 rotates due to the rotation of cam 17, it may rotate freely with respect to driven wheel 45 until protrusion 43 contacts protrusion 49. In the example given above, this free rotation takes approximately 324′. Upon contact of protrusion 43 of drive wheel 33 with protrusion 49 of driven wheel 45, driven wheel 45 will begin to turn along with drive wheel 33, and cam 17, guide 9 and driven gear 5. Pin 14 continues to follow the appropriate smooth portion 21*a* or 21*b* of spiral surfaces 19*a* or 19*b* from the portion of the engaged spiral surface which is radially closer axis A of shaft 1 to a portion of the spiral surface which is radially further away form axis A of shaft 1.

When the rotation of gear 5, guide 9 and cam 17 reaches the point where the point of contact of pin 14 is at the appropriate step transition portion 23*a* or 23*b* of spiral surface 19*a* or 19*b*, the energy stored in spring 16 is transmitted through pin 14 and causes the point of contact of pin 14 to abruptly move from the smooth portion 21*a* or 21*b* down the step transition portion 23*a* or 23*b*, to the common base portion 25. This causes cam 17 to abruptly rotate or "snap" through a predetermined angle approximately equal to the angle between the line of symmetry S between spiral surfaces 19*a* and 19*b* of cam 17 and a plane containing the surface of a step transition portion 23*a* or 23*b*. For example, this angle may be approximately 36′.

The abrupt rotation of cam 17 is communicated to drive wheel 33 through the interaction of arm 35 with opening 37. The abrupt rotation of drive wheel 33, in turn is communicated to driven wheel 45 through the interaction of protrusion 43 of drive wheel 33 with protrusion 49 of driven wheel 45. Pins 51 of driven wheel 45 engage teeth 57 of gear 53 (which has eight teeth), causing gear 53 to rotate approximately 90′ (based upon the example given above). Register display wheel 61 engages teeth 57 of gear 53 via two of the twenty pins 59 formed on display wheel 61. Using the example given above, register display wheel 61 will abruptly rotate through approximately 36′ or 1/10 of its circumference. This causes a new display position 63 to be brought into view. When register display wheel has rotated through ten such abrupt movements, pins 65 will engage a gear similar to that of gear 53 to cause a subsequent register display wheel similar to wheel 61 to move to its next display position through this well-known decade counter "odometer-type" display mechanism.

It will be appreciated that if driven shaft 7 is rotated in a direction opposite to that described above, driven gear 5 will begin rotation in the opposite direction causing guide 9 to rotate and cam 17 to move laterally. Drive wheel 33 will once again move freely with respect to driven wheel 45 since protrusion 43 will rotate away from protrusion 49. When cam 17 has reached the end of its lateral displacement along guide 9, as constrained by the interaction of helical grooves 15 with protrusions 31*a*, 31*b* of cam 17, drive wheel 33 will be rotated with respect to driven wheel 45 until protrusion 43 contacts protrusion 49 of driven wheel 45 on a side opposite from that previously described. Because of the lateral displacement of cam 17 with respect to guide 9 and pin 14, pin 14 will follow the smooth portion of the other spiral surface. Upon rotation of cam 17 such that the point of contact of pin 14 follows the smooth spiral surface until it encounters the step transition portion of the spiral surface, cam 17 will abruptly rotate causing drive wheel 33 to rotate driven wheel 45 through a predetermined angle. This movement of driven wheel 45 causes pins 51 to engage teeth 57 of gear 53 which, in turn causes reverse rotation of register display wheel 61 through a predetermined angle to bring a new display position 63 into view.

It will be appreciated that in the described embodiment shaft 1 acts merely as a support for gear 5, guide 9, wheel 10, cam 17, driven wheel 33 and register display wheel 61. Each of these elements may rotate freely with respect to shaft 1 whose ends are fixed and which does not rotate. However, it is possible to arrange for shaft 1 to be coupled directly to driven gear 5 so that shaft 1 will rotate with gear 5. Furthermore, guide A may be formed as an integral part of shaft 1 with grooves 15 being formed directly on the surface of the shaft. However, cam 17, drive wheel 45 and register display wheel 61 would not be fixed with respect to shaft 1 and could rotate independent of shaft 1.

The foregoing arrangement enables the bi-directional cam 17 to "free wheel" with respect to register display wheel 61 except over a predetermined angular portion of its rotation. Thus, when the abrupt transition of the smooth portion of the spiral surface in contact with pin 14 to the step transition portion occurs, the register display wheel 61 will be quickly driven through a predetermined angular distance to bring a new display position into view. The coupling of display wheel 61 via a well-known decade counter mechanism to further register display wheels disposed coaxially along a common shaft enables the "snap-action" of the driven register display wheel 61 to be communicated to other register display wheels. Furthermore, the use of self-lubricating plastics for at least the biased pin 14 and bi-directional cam 17 ensures that drag and friction between the pin and cam is minimized. The register display mechanism is relatively inexpensive to manufacture and is simple in construction and operation, while providing the advantages of unambiguous display readings, due to the snap-action of the display mechanism, low drag and friction, ease of adaptability for use with conventional remotely interrogable register encoder mechanisms, and the ability to operate properly in both forward and reverse directions.

While the present invention has been described in considerable detail, the foregoing detailed description of the preferred embodiment is considered illustrative and not limitive of the scope of the invention which is defined in the appended claims.

What is claimed is:

1. A bi-directional snap-action register mechanism for a mechanical register display comprising:

at least one register display wheel having at least one display position provided thereon:

guide means disposed coaxially along a common rotational axis with the register display wheel;

a bi-directional cam disposed about the guide means, the bi-directional cam comprised of two spiral surfaces, each spiral surface having a smooth portion and a step transition portion provided thereon, the two spiral surfaces being oriented symmetrically mirror-reversed with respect to each other and arranged along a portion of a common shaft having guide means formed thereon, the bi-directional cam having means cooperating with the guide means to allow lateral displacement of the bi-directional cam in a direction parallel to the common rotational axis;

a pin biased by biasing means into contact with one of the spiral surfaces of the bi-directional cam; and means for coupling the bi-directional cam to the register display wheel;

whereby rotation of the guide means causes the biased pin to engage one of the two spiral surfaces of the bi-directional cam and causes the cam to abruptly rotate through a predetermined angular distance when the point of contact of the biased pin with the engaged spiral surface moves from the smooth portion of the engaged surface to the step transition portion of the engaged surface, the abrupt rotation of the cam being communicated to the register display wheel by the coupling means to cause a new display position to be moved into view.

2. The register mechanism of claim 1 wherein the biased pin contacts one of the two spiral surfaces of the cam depending upon the direction of axial rotation of the guide means.

3. The register mechanism of claim 1 wherein the coupling means comprises a drive wheel mounted coaxially with the guide means along the common axis between the register display wheel and the bi-directional cam, and a driven wheel mounted coaxially along the common axis and in the same plane as the drive wheel, the driven wheel having an annular opening for slidingly receiving the drive wheel, the drive wheel including means for engaging and driving the driven wheel and register display wheel over a predetermined angular distance and for rotating freely with respect to the driven wheel and register display wheel over another predetermined angular distance, the drive wheel further including means coupled to the bi-directional cam to cause the drive wheel to rotate with the bi-directional cam.

4. The register of claim 1 wherein the guide means comprises a helical groove arranged along the common axis to allow movement of the cam in a direction parallel to the common axis and without rotation of the cam with respect to the guide means over a predetermined amount of angular rotation of the guide means.

5. The register mechanism of claim 1 wherein the two spiral surfaces of the cam are arranged adjacent each other and are mirror-reversed about a line of symmetry extending from the axis of rotation of the cam through a base portion common to the step transition portions of the two spiral surfaces.

6. The register mechanism of claim 1 further including additional register display wheels disposed coaxially along the common axis and coupled to the register wheel through a decade counter mechanism.

7. The register mechanism of claim 1 further including a gear train coupled to the guide means for driving the guide means in a clockwise or counterclockwise direction.

8. The register mechanism of claim 6 wherein the decade counter mechanism is an odometer type mechanical register display.

9. The register mechanism of claim 1 further including remotely interrogable encoder means associated with at least one register display wheel.

* * * * *